United States Patent [19]

DeGabriele et al.

[11] 4,244,529

[45] Jan. 13, 1981

[54] INERTING OF PULVERIZING MILLS FOR COMBUSTIBLE MATERIALS

[75] Inventors: Robert M. DeGabriele, Negaunee, Mich.; Humberto Causilla, Jr., Rockville, Md.

[73] Assignee: The Cleveland Cliffs Iron Company, Cleveland, Ohio

[21] Appl. No.: 36,731

[22] Filed: May 7, 1979

[51] Int. Cl.[3] ..... B02C 17/00; B02C 23/18; B02C 23/24

[52] U.S. Cl. ..... 241/18; 241/31; 241/DIG. 14

[58] Field of Search ..... 241/15, 18, 31, DIG. 14

[56] References Cited

U.S. PATENT DOCUMENTS

| | | | |
|---|---|---|---|
| 2,565,420 | 8/1951 | Ayers | 241/31 X |
| 3,854,666 | 12/1974 | Switzer, Jr. | 241/18 |

OTHER PUBLICATIONS

"Development and Operating Experience with Inerting Systems on Coal Pulverizers and Bunkers", Amer. Power Conf., 1978 by J. E. Fisher.

*Primary Examiner*—Richard B. Lazarus

*Attorney, Agent, or Firm*—Bertram I. Rowland

[57] ABSTRACT

A method is provided for inhibiting the occurrence of explosions or puffs in a coal pulverizing mill by introducing a sufficient amount of water vapor into the primary air stream of a coal pulverizing system immediately prior to the introduction of coal at start-up and during stripping at shutdown.

12 Claims, 2 Drawing Figures

FIG.IA
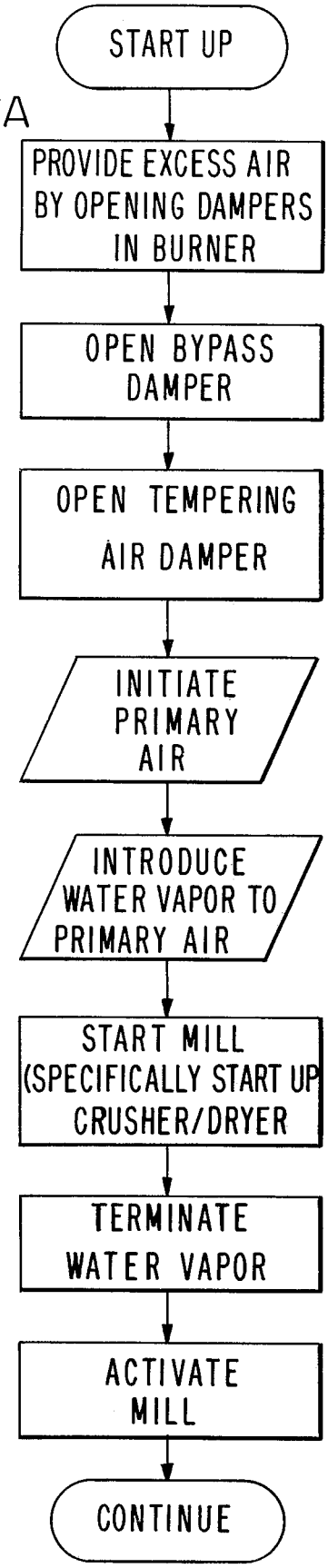
FIG. IB
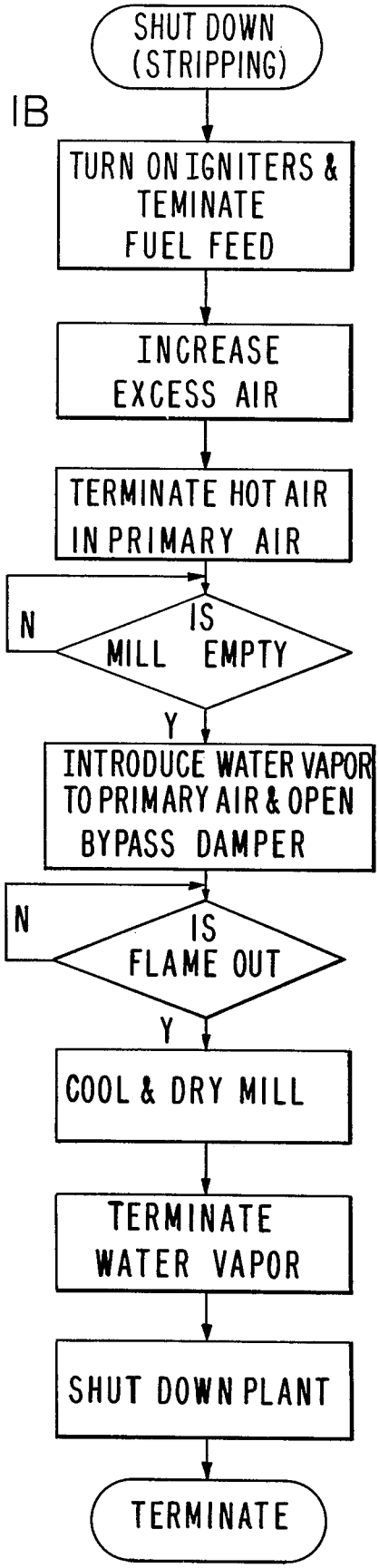

INERTING OF PULVERIZING MILLS FOR COMBUSTIBLE MATERIALS

BACKGROUND OF THE INVENTION

1. Field of the Invention

In the pulverizing carbonaceous material e.g. coal, as a feedstock, particularly as a fuel for burners, a large amount of small particulate coal is produced, which with air can provide an explosive mixture. During operation of the mill, the large amount of fuel which is present, appears to inhibit explosions. However, during start-up and shutdown, the coal-air mixture must pass through a composition zone of explosive mixtures in going from the air rich to the fuel rich composition.

The problem is exacerbated with fuels, such as sub-bituminous coal. In the operation of the mill, air is employed at elevated temperatures. The sub-bituminous coal can become sticky and agglomerate and adhere to the hot walls of the mill. The coal can then begin to burn and/or remain in the mill during shutdown and subsequent start-up, which can act as an ignition source when the fuel-air composition passes through the explosion zone.

In attempting to inhibit explosions during start-up and shutdown, there are many considerations. The large volume of the mill inhibits the use of an expensive material, since large volumes of the material will be required. Furthermore, one cannot use some materials, because of their toxic or adverse physiological effects. In addition, one must be concerned about the effect of any inerting material on the coal, where the nature of the material is to leave a residue, particularly, as to the thermal efficiency of the coal. It is found that pulverized bituminous coal, and sub-bituminous even more so, will agglomerate in the presence of water and strongly adhere to the walls, requiring mechanical cleanout for safe operation. Therefore, in the past, when steam has been used for inerting the pulverizing system, it has been employed after the pulverizer has been shutdown and is in the sealed or bottled up condition. The system is then swept with air, to insure the substantial removal of any moisture, before the introduction of coal into the mill.

2. Brief Description of the Prior Art

U.S. Pat. No. 2,565,420 teaches the continued addition of water during grinding of various organic materials, where the heat of grinding vaporizes the water to provide an inert atmosphere. Descriptions of furnace explosion problems may be found in Coykendall, "Furnace-Boiler Fuel Explosion Protection," ASME Paper 64-PWR-8, Livingston, "Preventing Furnace Explosions Part No. 2," Combustion Engineering, and Fisher, "Development and Operating Experience with Inerting Systems on Coal Pulverizers and Bunkers," American Power Conference, 1978.

SUMMARY OF THE INVENTION

An inerting system is provided for inhibiting explosion during start-up and shutdown of carbonaceous material (hereinafter illustrated as coal) pulverizing mills, particularly having bituminous and sub-bituminous coal feedstocks. A sufficient amount of water vapor is introduced into the circulating air stream of the mill to inhibit explosion. The air stream is at ambient or mildly elevated temperature, and the water vapor provides sufficient water to inhibit explosions, while avoiding significant condensation and agglomeration of the coal. The water is introduced into the air stream at one or more positions where an explosive fuel-air mixture is likely to occur, normally prior to the entry of the air stream into the pulverizer and can be introduced in any convenient vapor form, such as steam or super heated steam. During start-up, the water vapor is introduced immediately prior to the feeding of the coal into the mill, while during shutdown, the water vapor is provided during stripping. By employing the water vapor as described, systems which had previous experiences of repetitive explosions and puffs during start-up and shutdown, have been substantially free of such experiences.

DESCRIPTION OF THE SPECIFIC EMBODIMENTS

The subject invention is concerned with methods for inerting carbonaceous material pulverizing mills during periods of time when the coal and air are in a composition range which has a high explosive potential. This range exists during start-up and shutdown, as the composition varies from air rich to fuel rich and vice-versa, passing through an explosive composition zone.

In accordance with the inerting system of the subject invention, during start-up for a short period of time, water vapor is introduced into the primary air stream, usually prior to the air stream entering the pulverizer, more usually, prior to its entering the coal feed duct. The amount of water is sufficient to provide for inerting—preventing explosions—while at a temperature and concentration that minimizes condensation, since condensation can result in agglomeration of coal particles. During shutdown, a phase is involved called stripping, where coal is no longer fed to the mill, but the mill continues operating but solely with tempering air, and the air stream blows all of the coal out of the mill. During stripping, water vapor is introduced into the air stream of tempering air, during a substantial portion of the stripping period. That is, during inerting there is no coal feed and tempering air is employed for the air stream.

The use of water vapor has a number of advantages. Water vapor is readily available and does not require storage, being particularly abundant and available as steam where most coal pulverizing mills are encountered. Water vapor is inexpensive, has no toxic effects, and does not require tight closure of the inerted space. Therefore, the ability to inert a coal pulverizing mill with water does not involve expensive additional equipment for providing the inerting fluid or protective devices for the handling of the inerting fluid.

While coal will be referred to as illustrative of combustible carbonaceous materials, it is to be understood that any combustible material, usually carbonaceous, which requires pulverization and can result in explosive mixtures with air can advantageously employ the subject invention. Besides coals, such as bituminous and sub-bituminous coal, other combustible materials such as lignite, and the like, may enjoy the benefits of the subject invention.

In describing the subject invention, the parameters of the use of the inerting fluid, water, will be considered first, followed by a generalized description of a coal pulverizing mill, followed by specific details as to a mill of a particular capacity.

The feedstock for the pulverizing mill is exemplified by coal, usually bituminous coal, and particularly sub-bituminous coal, which is used as a feedstock as a fuel for furnaces. The problem of explosion is severe with sub-bituminous coal, which is readily ignited under the conditions employed in pulverizing mills. In addition, the sub-bituminous coal can become very sticky, agglomerate, and adhere to the walls of the pulverizing mill. When adherent, the coal can ignite and provide a continuously available source of ignition, as well as require shutdown and mechanical removal of the adherent agglomerated coal. In pulverizing mills providing coal as a feed source for furnaces, the coal is pulverized, to provide a coal source of which not less than about 70 volume percent passes through a 200 U.S.S. sieve and not less than about 98% through a 50 U.S.S. sieve.

The pulverizing mill normally employs gravity feed for the coal and an air stream which provides means for transporting the coal particles after pulverization to the furnace or other ultimate use. The air stream is normally fed into the duct which serves as the coal feed conduit. The water vapor is introduced into the air stream, before the air stream enters the coal feed duct. The water vapor may be introduced in a variety of ways, so long as a sufficient amount of water is added to inhibit explosion while being less than an amount which results in significant condensation and agglomeration of coal with resulting adhesion of the coal to the mill surfaces. Usually the amount of water added will reduce the oxygen concentration of the air to less than about 18 volume percent, more usually less than about 16 volume percent, and usually to not less than about eight volumne percent. The water may be introduced as water vapor, saturated steam, or super heated steam, so long as the water under the mill conditions does not significantly condense.

The water vapor will be introduced under two different situations, and optionally a third. The first situation is at start-up. At start-up, there is substantially no coal in the mill. The tempering air stream is begun, the amount of air and velocity of which is sufficient to provide for transport of the coal for its ultimate use. The temperature of the air when contacted with the water vapor, is generally less than about 200° F. and can be as low as about ambient temperature. Therefore, when adding the water, the water must be added in a form and at a concentration that does not result in significant condensation as the temperature of the air drops, since the mill will be cooling during stripping.

The water vapor may be introduced into the primary air stream at any position in the mill where the potential for an explosive fuel-air mixture exists. Therefore, the water vapor may be introduced at one or more positions in the mill. Normally the water vapor will be introduced upstream from the pulverizer and conveniently may be introduced upstream from the merging of the coal-feed and primary air stream. The tempering air stream will generally range in temperature from about ambient to less than about 2000 ' F., while the hot air will normally be at a temperature substantially in excess of 500° F.

When introducing the water vapor during start-up, relatively short periods of time will be involved when the water vapor is introduced. Usually, at least about 5 secs, more usually 10 secs and usually less than about 1 min is involved for the water vapor introduction. The water vapor introduction is terminated at about the same time that the coal feed is introduced into the coal feed duct. Desirably, the moist air does not have a significant period of contact with the coal feed during start-up. During shutdown, there is a substantial period of time after coal feed has stopped, when the airflow is continued, in order to strip the mill of coal. During this period, it is desirable to introduce the water vapor for at least about 2 mins, preferably at least about 5 mins, usually not exceeding about 30 mins, generally from about 8 to 20 mins. Thus, water is maintained for a sufficient time prior to, during and subsequent to the existence of coal-air compositions which have an explosive tendency.

The third time when water vapor may be employed is after a trip. By trip is intended an unintended stoppage of the mill. In this situation, the mill has coal present. While the introduction of steam into a mill in a bottled up condition, namely a closed condition after a trip is known, water vapor has not previously been used in the manner of the subject invention, where it is introduced into the primary air stream, when the mill is either being shutdown by stripping or being put back into operation, without explosion.

In starting up a mill or shutting down a mill, there will be a particular sequence of events relating to the various parts of the mill and the processes with which they are involved. While the subject discussion will be directed to a single entry and exit of coal, it should be understood, that there may be a multiplicity of feed coal entries and pulverized coal exits, sometimes there being two of each, so that coal is fed into a central pulverizer from two directions. In order to understand the sequence of events, it is necessary to first describe an exemplary mill. The mill chosen as exemplary will be a ball tube mill which is used in conjunction with a crusher-dryer.

The raw coal from bunkers is fed to a coal feeder which controls the rate at which the coal is fed into the mill. The coal drops via gravity through a coal spout into a crusher-dryer. Intermediate between the coal feeder and the crusher-dryer is an air feed. The air is a mixture of hot air and tempering air, which allows for control of the air temperature. The temperature of the hot air is normally above about 500° F., frequently from about 550 ° to 600° F. Means are provided for mixing the two air streams and controlling the rate of flow of the air stream into the coal feed conduit prior to the crusher-dryer. That is, a stream of coal and air is fed simultaneously into the crusher-dryer. The coal is crushed to particles above its ultimate size and simultaneously dried by the hot air.

A substantial proportion of the heat from the air is transferred to the coal and employed in the vaporization of the water contained in the coal. Usually, the air exiting from the crusher-dryer will be at a temperature above 150°, generally from about 200° to 300° F. From the crusher-dryer, the ground coal is transferred by gravity through a conduit along with the air stream to an inlet box which feeds to a pulverizer, for example, a ball tube mill. The inlet box has a bypass damper to control the fraction of the air stream which passes into the ball tube mill and the fraction which is diverted to the outlet box.

In the pulverizer, the coal is further ground to provide coal particles of the desired size. The air stream flowing through the pulverizer will carry small particles out through the outlet box into a classifier. The classifier, for example a cyclone, rejects oversized particles and returns the oversized particles to the pulverizer. Particles which pass through the classifier are transported by the air stream to the next stage, normally as fuel in a coal burner. Shutoff valves are normally provided between the classifier and the burner.

In starting up the mill, the pulverizing mill is normally empty of any coal. Where the coal is for a burner, the burner is put into start-up position by the transfer of the burner cooling switch to off/standby, the light off of all ignitors on the burners served by the pulverizing mill in paired succession, and the verifying that the burner air registers are open and excess air is adequate (minimum 8% oxygen). Next, the sealing air to the mill, which also provides for an air seal at the gravity feeder and crusher-dryer for the coal is verified to be at the desired pressure, normally about 12" water column above the operating pressure of the mill. The damper positions are then checked to insure that the hot air damper is closed, the tempering air damper, which passes air at substantially ambient temperatures, is open, and the bypass is open. Additional safety factors are also initiated so far as the cooling water flow, and the mill lubrication system.

The primary air fans are then started. When the mill is about ready to start-up, water vapor, desirably superheated steam at a temperature in the range of about 225° to 275° F. is introduced into the air stream, prior to the air stream passing into the coal feed duct, at a pressure of up to about 20 psig and the water vapor introduction continued for about 10 secs. The mill is started, with starting up the crusher-dryer and the introduction of water vapor terminated. The mill is then activated in accordance with conventional procedures involving controlling the classifier exit temperature, control of the pressure drop, between the classifier and the furnace, controlling the pressure drop in the mill, starting the coal feeders, and balancing the particular mill with one or more other mills which may also service the same furnace.

When the stripping operation is in effect, the operator terminates coal addition and places ignitors for operating burners in service and raises excess air ($\sim$8% $O_2$), followed by his adjusting the dampers to close the hot air, and completely open the tempering air, and adjusting the pressure differential between classifier and furnace to a minimum. Inerting is started when the mill sound level equals 88 db signifying emptying of the mill and the by-pass damper is gradually closed to sweep the mill clean. Upon loss of coal flame and when the mill sound level is about 92.5 db signifying an empty mill, steam addition is terminated and the mill cooled and dried by adjusting the rating damper to obtain 15" w.c. pressure differential between the classifier and burner. The plant is then shut down in accordance with conventional procedures as the temperatures drop.

Depending upon the period of stripping, the introduction of water vapor may be continued for as much as 20 mins, and not less than about 2 mins, usually being in the range of about 8 to 15 mins; the addition of water vapor is maintained for a sufficient period to insure its presence when the coal-air composition is capable of explosion.

In accordance with the subject invention, a pulverizing mill involving a crusher-dryer, and a ball mill for reducing coal of about 1" to about 200 mesh was studied. The subject mill had a capacity of about 58,000 lbs. of coal/hr and had a severe problem of explosions and puffs during start-up and shutdown. The plant employed a hot air stream at a flowrate of about 47,000 lbs/hr or more at a temperature of about 550°-600° F. The air underwent a temperature drop through the crusher-dryer to below about 250° F. and out of the classifier at a temperature of about 120°-150° F., usually about 130°-135° F. It was found that by introducing steam at about 250° F. at a rate of about 26,000 lbs/hr for about 10 secs during start-up and for about 8 to 15 mins during shutdown, the previous history of explosions was virtually eliminated. The steam was at a pressure of from about 15 to 20 psig. After a trip, when the plant was shutoff, by introducing steam under the same conditions for about 2 mins, explosions or puffs were also prevented.

In accordance with the subject invention, a convenient, rapid and safe method is provided for preventing explosions in coal pulverizing mills. The method employs as an inerting medium, water vapor which is inexpensive and abundant and which is supplied in an efficient amount to inhibit explosions, while at a level which avoids agglomeration of the coal feed stock. The subject method permits the continued and efficient operation of a pulverizing mill without requiring expensive clean-up and shutdown due to agglomeration and adhesion of the coal to the mill surfaces.

Although the foregoing invention has been described in some detail by way of illustration and example for purposes of clarity of understanding, it will be obvious that certain changes and modifications may be practiced within the scope of the appended claims.

What is claimed is:

1. In a method for pulverizing a carbonaceous combustible material in a pulverizing mill having a pulverizing zone to produce particles of said combustible material, said method comprising the steps of:

(1) starting up said mill by (a) directing into said pulverizing zone at an elevated temperature a primary air stream derived from a hot air stream and a tempering air stream, said primary air stream serving to dry and transport said combustible material particles through said mill; and (b) feeding said combustible material into said pulverizing zone;

(2) pulverizing said combustible material into particles in said pulverizing zone;

(3) discharging said combustible material particles from said pulverizing zone and mill by means of said primary air stream; and (4) shutting down said mill by terminating the feeding of said combustible material while continuing said pulverizing and maintaining said primary air stream comprising at least said tempering air stream to discharge substantially all of said combustible material from said mill;

wherein during start-up and shutdown, the combustible material-air mixture passes through a composition zone of explosive mixtures;

the improvement for preventing explosions in said mill which comprises;

introducing at start-up and shutdown into said primary air stream at a site upstream from or at said pulverizing zone sufficient water vapor to reduce the oxygen content of said air stream to an amount in the range of about 8 to 18 volume %, said water vapor being in an amount less than an amount resulting in significant agglomeration and adhesion of said combustible materials to the walls of said mill;

said water vapor being introduced during start-up at a time at least immediately prior to introduction of said combustible material into said pulverizing zone and terminating at about the time of addition of said combustible material into said pulverizing zone; and during shutdown, said water vapor being introduced at a time at about said termination of said feeding of said combustible material, and terminating when said primary air stream and said combustible material no longer form an explosive mixture.

2. A method according to claim 1, wherein said combustible material is coal.

3. A method according to any of claims 1 or 2, wherein said water vapor is added during start-up for a period of at least about 5 secs. and not more than about 30 secs.

4. A method according to any of claims 1 or 2, wherein said water is added during shutdown for a period of at least about 2 mins. and not more than about 30 mins.

5. A method according to claim 2, wherein said coal is sub-bituminous.

6. A method according to any of claims 1, or 2, wherein said water vapor is introduced at a temperature of at least about 212° F.

7. In a method for pulverizing coal in a pulverizing mill having a gravity feed duct directing coal into a pulverizing zone to produce particles of said coal, said method comprising the steps of:

(1) starting up said mill by (a) directing into said pulverizing zone at an elevated temperature a primary air stream derived from a hot air stream and a tempering air stream, said primary air stream serving to dry and transport said coal particles through said mill; and (b) feeding said coal through said duct into said pulverizing zone;

(2) pulverizing said coal into particles in said pulverizing zone;

(3) discharging said coal particles from said pulverizing zone and mill by means of said primary air stream; and (4) shutting down said mill by terminating the feeding of said coal while continuing said pulverizing and maintaining said primary air stream comprising at least said tempering air stream to discharge substantially all of said coal from said mill;

wherein during start-up and shutdown, the coal-air mixture passes through a composition zone of explosive mixtures;

the improvement for preventing explosions in said mill which comprises:

introducing steam at start-up and shutdown into said primary air stream at a site upstream from or at said pulverizing zone, said steam being at a temperature of at least about 212° F. and added in an amount sufficient to reduce the oxygen content of said air stream to an amount in the range of about 8 to 18 volume %, said water vapor being in an amount less than an amount resulting in significant agglomeration and adhesion of said combustible material to the walls of said mill;

during start-up, said steam is introduced at a time at least immediately prior to introduction of said coal into said pulverizing zone and terminating at about the time of addition of said coal into said pulverizing zone; and during shutdown, said stream is introduced at a time about said termination of said feeding of said coal and terminating when said primary air stream and said coal no longer form an explosive mixture.

8. A method according to claim 7, wherein said steam is at a temperature of at least about 250° F.

9. A method according to any of claims 7 to 8, wherein said steam is introduced during start-up for a time in the range of about 5 secs. to 1 min. and during shutdown for a time in the range of about 5 to 20 mins.

10. In a method for pulverizing a carbonaceous combustible material in a pulverizing mill having a pulverizing zone to produce particles of said combustible material, said method comprising the steps of:

(1) starting up said mill by (a) directing into said pulverizing zone at an elevated temperature a primary air stream derived from a hot air stream and a tempering air stream, said primary air stream serving to dry and transport said combustible material particles through said mill; and (b) feeding said combustible material into said pulverizing zone;

(2) pulverizing said combustible material into particles in said pulverizing zone;

(3) discharging said combustible material particles from said pulverizing zone and mill by means of said primary air stream; and (4) shutting down said mill by terminating the feeding of said combustible material while continuing said pulverizing and maintaining said primary air stream comprising at least said tempering air stream to discharge substantially all of said combustible material from said mill;

wherein during start-up said combustible material-air mixture passes through a composition zone of explosive mixtures;

the improvement for preventing explosions during start-up which comprises:

introducing at start-up into said primary air stream at a site upstream from or at said pulverizing zone sufficient water vapor to reduce the oxygen content of said air stream to an amount in the range of about 8 to 18 volume %, said water vapor being in an amount less than an amount resulting in significant agglomeration and adhesion of said combustible material to the walls of said mill;

said water vapor being introduced at a time at least immediately prior to introduction of said combustible material into said pulverizing zone and terminating about the time of addition of said combustible material into said pulverizing zone.

11. In a method for pulverizing a carbonaceous combustible material in a pulverizing mill having a pulverizing zone to produce particles of said combustible material, said method comprising the steps of:

(1) starting up said mill by (a) directing into said pulverizing zone at an elevated temperature a primary air stream derived from a hot air stream and a tempering air stream, said primary air stream serving to dry and transport said combustible material particles through said mill; and (b) feeding said combustible material into said pulverizing zone;

(2) pulverizing said combustible material into particles in said pulverizing zone;

(3) discharging said combustible material particles from said pulverizing zone and mill by means of said primary air stream; and (4) shutting down said mill by terminating the feeding of said combustible material while continuing said pulverizing and maintaining said primary air stream comprising at least said tempering air stream to discharge substantially all of said combustible material from said mill;

wherein during shutdown, said combustible material-air mixture passes through a composition zone of explosive mixtures;

the improvement for preventing explosions in said mill during shutdown which comprises:

introducing at shutdown into said primary air stream at a site upstream from or at said pulverizing zone sufficient water vapor to reduce the oxygen content of said air stream to an amount in the range of about 8 to 18%, said water vapor being in an amount less than an amount resulting in significant agglomerating and adhesion of said combustible material to the walls of said mill;

said water vapor being introduced at a time about said termination of said feeding of said combustible material and terminating when said primary air stream and said combustible material no longer form and explosive mixture.

12. A method according to any of claims 10 or 11, wherein said water vapor is steam at a temperature of at least about 212° F.

* * * * *